United States Patent [19]

Deutschmann et al.

[11] Patent Number: 4,807,436

[45] Date of Patent: Feb. 28, 1989

[54] ARRANGEMENT FOR THE MOUNTING OF EXHAUST GAS LINES

[75] Inventors: Herbert Deutschmann, Friedrichshafen; Gerd-Michael Wolters, Immenstaad; Otto Reifenscheid, Friedrichshafen, all of Fed. Rep. of Germany

[73] Assignee: MTU Motoren- und Turbinen-Union Friedrichshafen GmbH, Friedrichshafen, Fed. Rep. of Germany

[21] Appl. No.: 171,871

[22] PCT Filed: Jul. 3, 1987

[86] PCT No.: PCT/DE87/00303

§ 371 Date: Feb. 2, 1988

§ 102(e) Date: Feb. 2, 1988

[87] PCT Pub. No.: WO88/02060

PCT Pub. Date: Mar. 24, 1988

[30] Foreign Application Priority Data

Sep. 13, 1986 [DE] Fed. Rep. of Germany ..... 3631312

[51] Int. Cl.[4] ..... F01N 7/10

[52] U.S. Cl. ..... 60/322; 60/323

[58] Field of Search ..... 60/322, 323

[56] References Cited

U.S. PATENT DOCUMENTS

| | | | |
|---|---|---|---|
| 3,941,409 | 3/1976 | Rameau | 60/322 |
| 4,117,671 | 10/1978 | Tadokoro | 60/322 |
| 4,197,704 | 4/1980 | Date | 60/323 |
| 4,458,491 | 7/1984 | Deutschmann | 60/323 |

*Primary Examiner*—Douglas Hart

*Attorney, Agent, or Firm*—Barnes & Thornburg

[57] ABSTRACT

The invention relates an arrangement for the mounting of exhaust gas lines which are arranged in an exhaust gas-tight space, and serve for the transfer of the combustion gases from the exhaust openings of the cylinder heads to the exhaust gas manifold. By reason of the high temperature load of the exhaust gas lines which are not cooled in the exhaust gas-tight space, the mounting is so constructed that no compulsory forces can occur which stem from the temperature strain. This is achieved by a point-shaped mounting of flanges connected with the exhaust gas lines at only one circumferential place each. The single point fastening assures a radial and axial expansion possibility of the exhaust gas lines under thermal load free of compulsory forces. The exhaust gas lines are threadably secured each by means of fastening bolts within the area of the ends of the cylinder head side preferably at the cylinder head or at wall parts of the components forming the exhaust gas-tight space. The fastening by means of bolts is safe and space-saving.

15 Claims, 3 Drawing Sheets

ARRANGEMENT FOR THE MOUNTING OF EXHAUST GAS LINES

Figure 1:
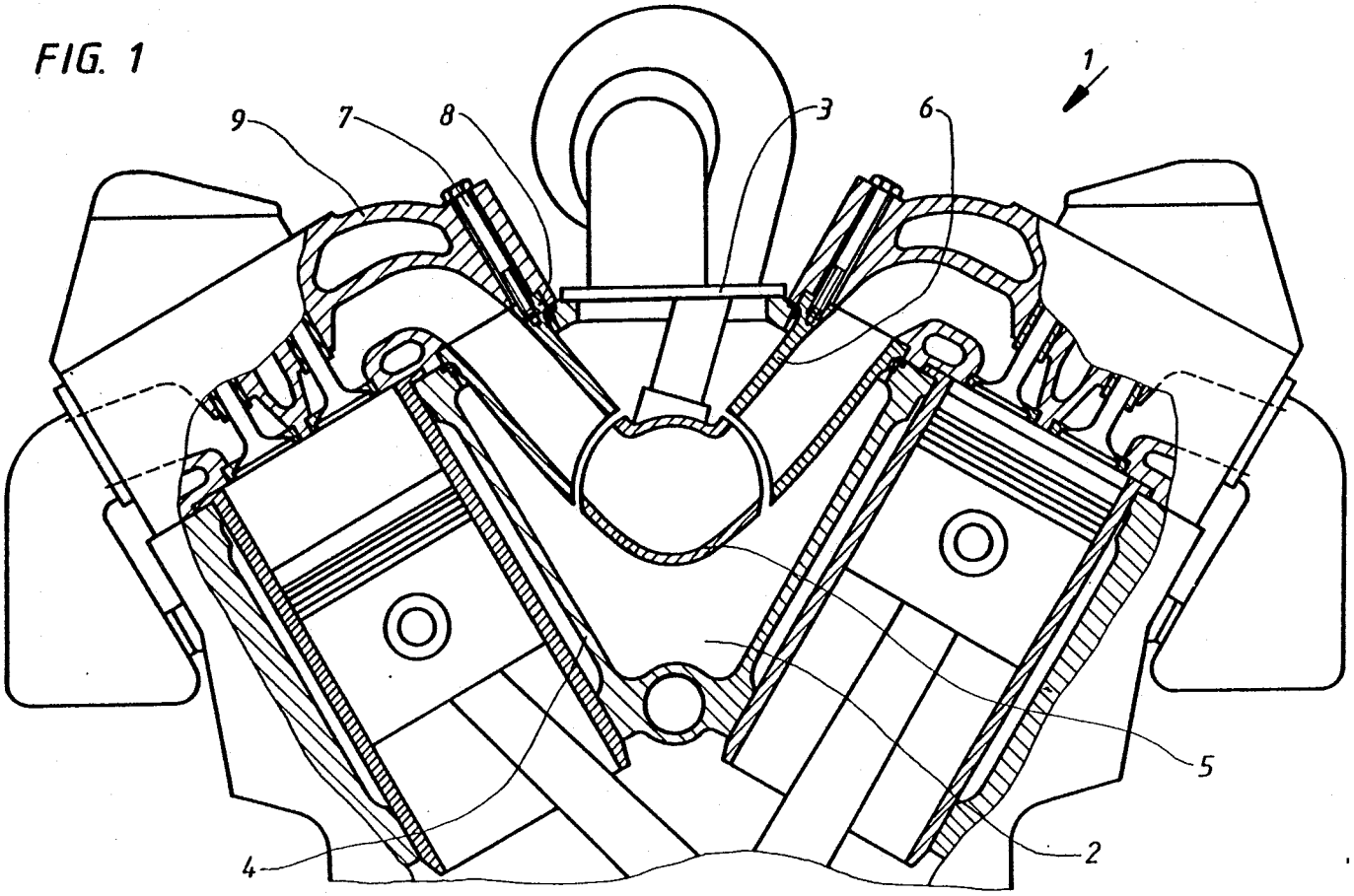

The invention relates to an arrangement for the mounting of exhaust gas lines according to the preamble of the claim 1, as is disclosed, for example, from the DE-OS No. 31 50 001.

An internal combustion engine with V-shaped row arrangement of the cylinders is illustrated in the aforementioned DE-OS No. 31 50 001. The exhaust gas manifold as well as the exhaust gas lines conducting the combustion gases from the exhaust openings of the cylinder heads to the exhaust gas manifold are located completely in an exhaust gas-tight space which is formed by the V-shaped section of the cylinder crankcase covered by a cover hood. Owing to the arrangement inside of the exhaust gas-tight space, the exhaust gas lines need not be cooled, as a result of which the energy content of the exhaust gases remains preserved and the supercharging is improved. However, by reason of the high temperatures, also greatest demands are made of the material and construction of the exhaust gas lines and of their mountings. The exhaust gas lines are fixed at the exhaust gas manifold in plug connections. The other ends terminate freely in the exhaust openings at the cylinder head. With the mounting at the exhaust gas manifold, the forces which occur as a result of temperature strain are relatively small because a corresponding temperature strain takes place owing to the approximately equally high temperatures of the exhaust gas lines and of the exhaust gas manifold. As the ends on the cylinder head side are free, in particular also an unimpaired length expansion free of compulsive forces is possible. However, radially acting clamping forces within the area of the plug connection cannot be avoided which are necessary for a safe seat of the exhaust gas lines. However, in the full load operation of the internal combustion engine, the temperatures of the exhaust gases and therewith of the exhaust lines are so high that the material is no longer able to withstand even small forces. This leads to permanent deformations within the clamping area as a result of the clamping forces acting thereat and therewith to the decline of the clamping action when cooling off. Especially in the partial load operation, no secure, completely satisfactory seat of the exhaust gas lines is then assured any longer. With continuous dynamic load, this would lead very quickly to damages of the exhaust gas line system. Furthermore, the construction of the plug-in mounting is quite expensive. In particular also welding seams can not be avoided which represent weak places under high temperature load.

Exhaust gas manifold pipe and exhaust gas lines of an internal combustion engine disclosed in the DE-PS No,. 26 53 263 are also arranged in an exhaust gas-tight space. The exhaust gas manifold is assembled in that case of pipe sections one plugged into the other, which is to permit an unimpaired length compensation. It is disadvantageous that the exhaust gas lines which conduct the combustion gases from the cylinder heads to the exhaust gas manifold, are welded onto the pipe sections of the exhaust gas manifold. On the side of the cylinder head, the exhaust gas lines are securely bolted at flanges each by means of two bolts to the water-cooled housing of the exhaust gas-tight space. As the flanges are thus cooled, they are capable without difficulty to absorb strain deformations which result from the clamping-in by several fastening bolts. However, in this case, a complicated water-cooled housing is needed which also includes the area of the cylinder head exhaust openings.

The invention is based on the task to so mount the exhaust gas lines that with a view toward the optimum supercharging without disturbing cooling of the exhaust gas lines and of the fastening area no significant forces occur in the clamping area in all temperature ranges and especially also at highest temperatures, and nonetheless a safe and immovable seat of the exhaust gas lines is assured.

This task is solved with an arrangement of the aforementioned type by the characterizing features of the claim 1. By one-point fastening of the flanges connected with the exhaust gas lines at the cylinder head or at other parts of the combustion engine, it is precluded that radial or axial compulsive stresses occur which at high temperature load would lead to the destruction of the material of the exhaust gas lines. Fastening bolts assure a safe and permanent connection which are screwed-in from outside of the exhaust gas-tight space, and which hold the flanges of the exhaust gas lines point-shaped at respectively one circumferential place.

Figure 2:
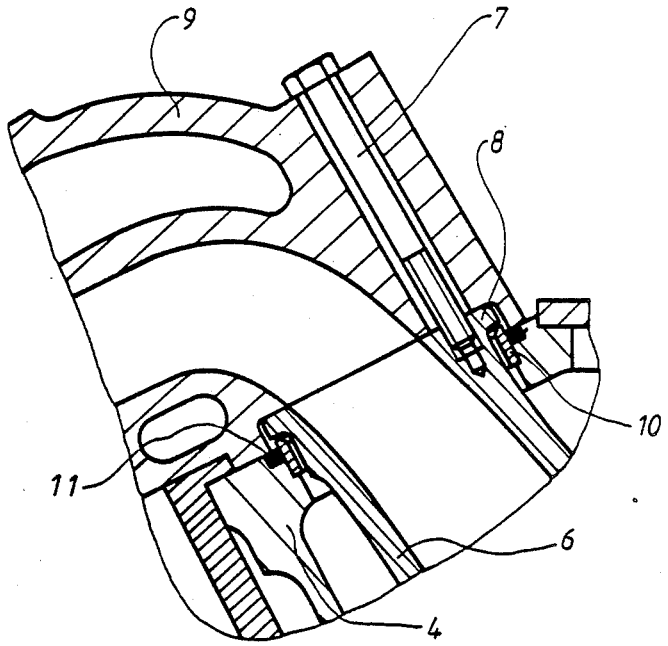
Figure 3:
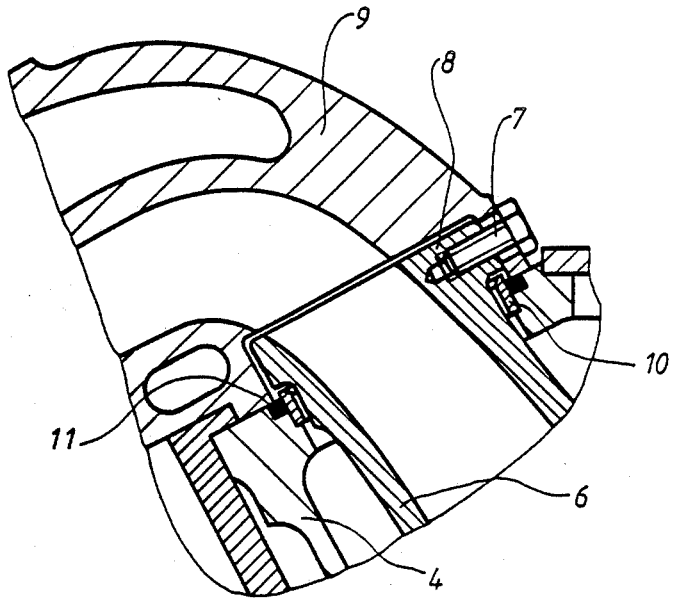
Figure 4:
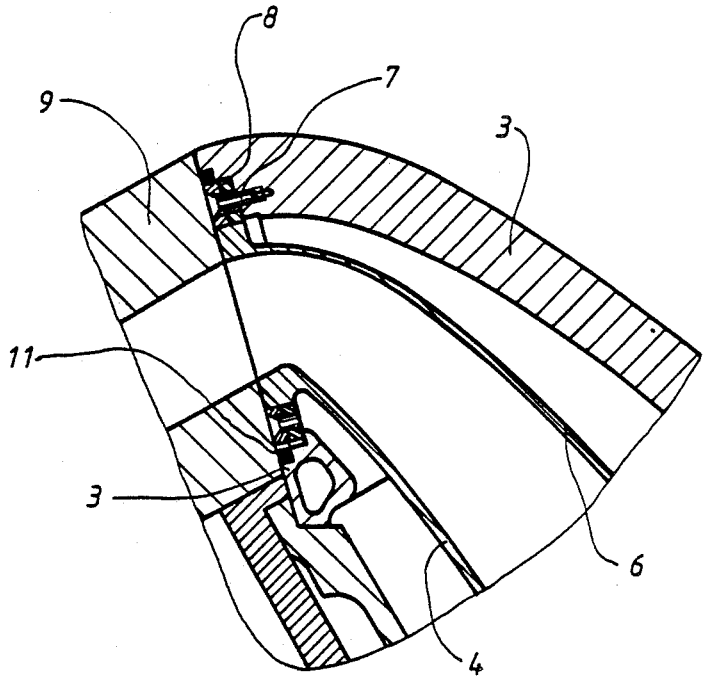

Embodiments of the invention are illustrated in the drawings and will be described more fully hereinafter; it is shown:

FIG. 1 a cross section through a piston internal combustion engine with an exhaust gas-tight space within the area between V-shaped arranged cylinder rows;

FIG. 2 a cross-sectional view corresponding to FIG. 1 in the area of the fastening of an exhaust gas line at the cylinder head;

FIG. 3 an illustration corresponding to FIG. 2 with another construction of the fastening place and other position of the fastening bolt;

FIG. 4 an illustration also corresponding to FIG. 2 with pivotal fastening of the exhaust gas line.

In the cross-section illustrated in FIG. 1 through a piston internal combustion engine 1 with V-shaped arrangement of the cylinder rows, an exhaust gas-tight space 2 is located in the V-shaped section of the cylinder crankcase 4 covered off by a cover hood 3. The exhaust gas manifold 5 is located in the exhaust gas-tight space 2, to which are conveyed the combustion gases conducted away from the cylinder heads 9 by way of the exhaust gas lines 6. The exhaust gas lines 6 are secured in flanges 8 by means of fastening bolts 7 at the cylinder head 9 in one circumferential place each.

FIGS. 2, 3 and 4 illustrate possible constructions of the fastening area of a corresponding exhaust gas line 6. According to FIGS. 2 and 3 the flange 8 serving for the fastening is constructed in one piece with the exhaust gas line 6. According to FIG. 2, the flange and the fastening area, at the engine are so constructed that the fastening bolts 7 are disposed approximately parallel to the axial direction of the exhaust gas line 6. In contrast, FIG. 3 illustrates a construction in which the fastening bolts 7 are disposed approximately transversely to the pipe axis. Cylinder head and cylinder crankcase are thereby s shaped that the flow deflection still takes place in the cylinder head. The possibility then exists to screw-in the fastening bolts 7 from above and from outside the exhaust gas-tight space 2. The tight fit of the bolts can thus be controlled advantageously from the outside.

As each exhaust gas line 6 is secured at the cylinder head 9 at only one circumferential place each at the flange 8 by one fastening bolt 7 each, no compulsory forces can occur at the clamping place as a result of differing temperature conditions in exhaust gas lines and cylinder head, respectively, cover hood which stress the wall material from a strength point of view. In order that the radial deformation of the exhaust gas line is not prevented, lateral radial free space is provided all around in the fastening area. The flange 8 of an exhaust gas line 6 is preferably constructed as ring-shaped circumferential collar which is radially guided between wall parts of the cylinder head and of the covering hood, respectively, the radial end surface of a shielding ring 10. It is prevented by this radial guidance that in case of dynamic load, the clamping area is stressed as regards strength as a consequence of bending vibrations of the exhaust gas lines. The ring-shaped circumferentially constructed collar therefore represents an axially supportable edge.

The through-openings between cylinder head and exhaust gas-tight space are sealed off by means of seals 11 which are located behind a shielding ring 10. The shielding ring protects the seals 11 against excessive heating. These seals are required because a gap must be present between cylinder crankcase and cylinder heads if the sealing of the combustion space against the cylinder heads is to be assured.

In the embodiment according to FIG. 4, the exhaust gas line 6 is jointedly connected with a flange 8, which is formed by clamping rings. The clamping rings are constructed two-partite for assembly reasons and are screwed together with each other. The exhaust gas line 6 is rotatably retained by spherically shaped surfaces on the clamping rings and corresponding surfaces at a collar formed-on at the exhaust gas line 6. Nonetheless, the radial expansion in the fastening area is not prevented because the clamping rings retaining the exhaust gas line 6 are secured at only one single circumferential place each--point-shaped--at the cover hood 3 for the exhaust gas-tight space 2. As for the flange 8 rigidly connected with the exhaust gas line 6, radial free space for the expansion is provided at the circumference of the clamping rings. The clamping rings are supported in a radial guidance at a further circumferential place or also along the entire circumference which permits radial but not axial movements directed orthogonally to the support surface. The other end of the exhaust gas line 6 may abut, which, however, is not illustrated, along the outer circumference gap-free at the edges of the openings of the exhaust gas manifold which are bent up into an annular bead. A nearly sealed conduction of the combustion gases from the cylinder head to the exhaust gas manifold pipe thus takes place. By reason of the jointed mounting of the exhaust gas lines in the clamping rings, displacements of the exhaust gas manifold pipe as a result of the temperature load cause no forces in the mounting or forces barely worth mentioning. However, a transfer of the combustion gases which is as free from losses as possible is desired because, in that case, the greatest possible energy content of the exhaust gases can reach the exhaust gas turbine of the exhaust gas turbocharger. In contrast thereto, in the embodiments according to FIGS. 2 and 3, certain losses have to be accepted because with a non-jointed mounting, the exhaust gas line, as shown in FIG. 1, terminates at a distance in front of the exhaust gas manifold.

The fastening of the clamping rings according to FIG. 4 takes place by means of a fastening bolt 7 disposed parallel to the direction of extension of the exhaust gas line. Cylinder head, exhaust gas line and cover hood are thereby so constructed that the fastening of the exhaust gas line takes place at the cover hood and after assembly of the cover hood, the bolt head is disposed opposite cylinder head walls. The advantage is achieved thereby that the fastening bolts are secured against unscrewing.

The seal of the passage between cylinder head and exhaust gas line takes place by means of a seal 11 located in the cooler area on the outer circumference of the clamping rings forming the flange 8.

In the embodiments, the exhaust gas lines 6 are constructed as cast parts. This has the advantage that the pipes can be manufactured in a price-favorable manner with a shape optimally matched to the flow conditions. With cast-on flange in particular strength-reducing welding seams or the like are avoided.

The embodiments illustrated in the figures show a construction of the exhaust gas lines and of the fastening area which represents a continuous bent-free extension of the exhaust channel of the cylinder head. However, it is also quite feasible to so form-on the fastening flange at the exhaust gas pipe that adjoining the flow deflection in the cylinder head, a constriction with following enlargement of the pipe cross section is provided. A large flange area is then formed which is favorable for the fastening. Also for flow-technical reasons, a constriction adjoining a flow deflection with following enlargement can be advantageous. As a result of the centrifugal forces in a curved channel, the pressure of the flow medium is higher in the outer area than inwardly. After a deflection, this may lead to a flow detachment owing to a sudden pressure increase which is weakened by the constriction with following enlargement.

What is claimed:

1. An arrangement for mounting exhaust gas line means conducting the combustion spaces from exhaust openings of cylinder-heads of an internal combustion engine to an exhaust gas manifold means, said exhaust gas line means like the exhaust gas manifold means being arranged completely within an exhaust gas-tight space, each exhaust gas line means being connected at its end on the side of the cylinder head with a flange means, and the flange means being secured at the internal combustion engine in only a single circumferential place.

2. An arrangement according to claim 1, wherein the flange means is secured at the internal combustion engine in a point-shaped manner.

3. An arrangement according to claim 1, wherein the flange means includes a guidance means at least at one additional circumferential place which prevents pivot movements of the flange means, but permits movements in the plane of the extension of the flange means.

4. An arrangement according to claim 3, wherein the flange means is constructed in one piece with the respective exhaust gas line means.

5. An arrangement according to claim 3, wherein the flange means includes spherically shaped surfaces in which a collar connected with the exhaust gas line means is pivotally supported.

6. An arrangement according to claim 5, wherein the fastening of the flange means takes place at boundary walls of wall parts forming the exhaust gas-tight space.

7. An arrangement according to claim 5, wherein the fastening of the flange means takes place at the cylinder head.

8. An arrangement according to claim 3, wherein the fastening of the flange means takes place in each case by means of a fastening bolt adapted to be screwed-in from outside of the exhaust gas-tight space.

9. An arrangement according to claim 1, wherein the flange means is constructed in one piece with the respective exhaust gas line means.

10. An arrangement according to claim 8, wherein the flange means includes spherically shaped surfaces in which a collar connected with the exhaust gas line means is pivotally supported.

11. An arrangement according to claim 10, wherein the fastening of the flange means takes place at boundary walls of wall parts forming the exhaust gas-tight space.

12. An arrangement according to claim 1, wherein the fastening of the flange means takes place at the cylinder head.

13. An arrangement according to claim 1, wherein the fastening of the flange means takes place in each case by means of a fastening bolt adapted to be screwed-in from outside of the exhaust gas-tight space.

14. An arrangement according to claim 1, wherein the flange means includes spherically shaped surfaces in which a collar connected with the exhaust gas line means is pivotally supported.

15. An arrangement according to claim 1, wherein the fastening of the flange means takes place at boundary walls of wall parts forming the exhaust gas-tight space.

* * * * *